United States Patent [19]

Graffman

[11] B 4,007,000

[45] Feb. 8, 1977

[54] COMPRESSED OIL BURNER STARTING MECHANISM

[75] Inventor: Johan Holger Graffman, Danderyd, Sweden

[73] Assignee: Clean Air Company, Inc., Panama

[22] Filed: Nov. 2, 1973

[21] Appl. No.: 412,124

[44] Published under the second Trial Voluntary Protest Program on March 23, 1976 as document No. B 412,124.

[30] Foreign Application Priority Data

Nov. 3, 1972 Sweden ..... 14262/72

[52] U.S. Cl. ..... 431/1; 239/102

[51] Int. Cl.² ..... F23C 3/02

[58] Field of Search ..... 431/1; 239/101, 102

[56] References Cited

UNITED STATES PATENTS

| | | | |
|---|---|---|---|
| 1,631,984 | 6/1927 | Redmond | 123/139 AW |
| 3,194,162 | 7/1965 | Williams | 239/102 |
| 3,221,798 | 12/1965 | Kofink | 236/1 A |
| 3,411,704 | 11/1968 | Hilgert et al. | 417/326 |

FOREIGN PATENTS OR APPLICATIONS

| | | | |
|---|---|---|---|
| 807,978 | 3/1969 | Canada | 431/1 |
| 1,293,753 | 4/1962 | France | 431/1 |
| 1,236,674 | 6/1960 | France | 431/1 |
| 1,361,886 | 4/1964 | France | 431/1 |
| 1,171,550 | 6/1964 | Germany | 431/1 |
| 1,063,300 | 3/1967 | United Kingdom | 431/1 |

*Primary Examiner*—Charles J. Myhre
*Assistant Examiner*—William C. Anderson
*Attorney, Agent, or Firm*—Stevens, Davis, Miller & Mosher

[57] ABSTRACT

A compressed oil burner which includes an operating nozzle having a valve body which is yieldingly loaded against a valve seat in a direction opposite to the flow direction so that fuel is supplied at a pulsating pressure, a sleeve surrounding the operating nozzle with adjustable dampers for supplying air thereto and check valves for exhausting fuel and air mixtures, a separate starting nozzle having an air fuel mixing chamber with outflow apertures positioned on the sleeve in front of the operating nozzle and fuel and air inlets into the chamber to supply fuel and air thereto when the fuel supply to the operating nozzle is closed.

6 Claims, 1 Drawing Figure

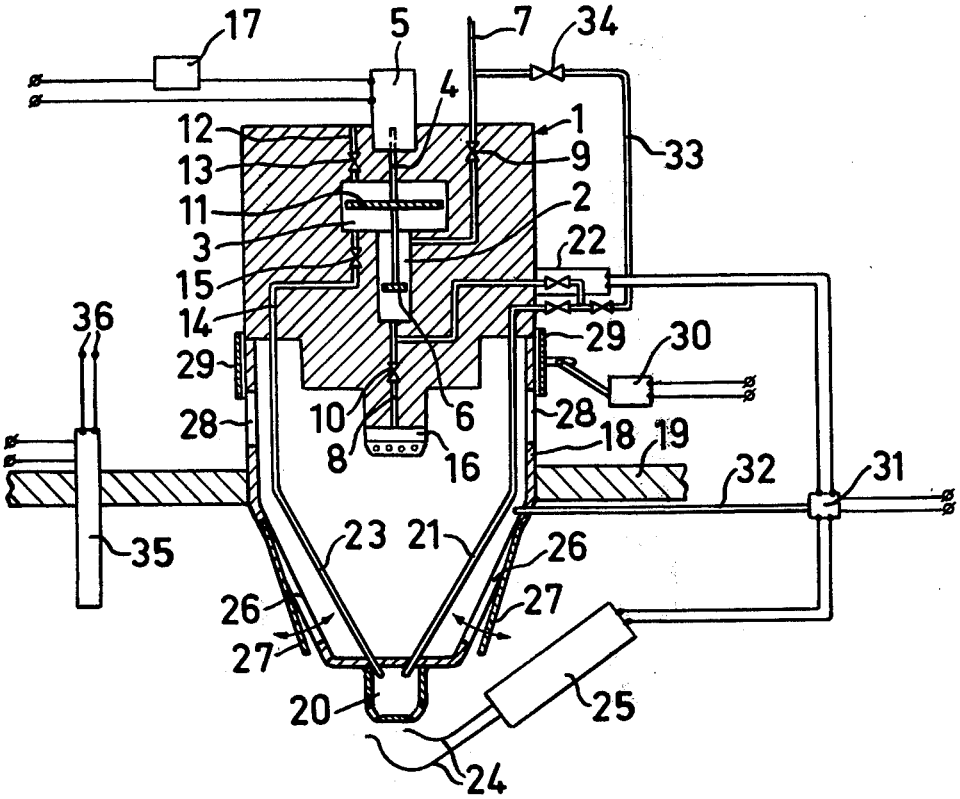
17
5
7
34
4
1
12
9
33
13
11
2
3
22
15
14
36
29
30
29
10
6
28
28
8
18
19
16
32
31
35
23
21
26
26
27
27
20
25
24

COMPRESSED OIL BURNER STARTING MECHANISM

The present invention relates to an improvement in compressed oil burners, the operating jet of which comprises a valve body, which is yieldingly loaded against a valve seat in a direction contrary to the flow direction of the fuel so that the valve body performs vibrations towards and from the valve seat at the supply of the fuel with pulsating pressure between the valve body and the valve seat.

Pressure oil burners of said kind are known, but lack the possibilities for stepless variation to vary the yielded effect. Therefore it is the object of the present invention to establish such a function that the pressure oil burner can be varied as to yielded effect, i.e. from a very low effect to full effect. Moreover, the invention provides especially the possibility of modifying the oil burner so that it is especially suitable for pulsating combustion and consequently gives extraordinary combustion properties, a possibility for stepless variation and excellent starting possibilities.

In order to achieve said objects the invention has been provided with the characteristic features set forth in the appended claims.

The invention will be described in the following under reference to the enclosed drawing FIGURE, which shows schematically and partly in section the basic design of the invention with modifications.

The pressure oil burner comprises a body 1, in which there are a piston-cylinder-pump device 2 and an air compressor 3, which are adapted after each other on the same shaft 4 and driven by an electromagnetic means 5. The shaft is driven by the aid of the electromagnetic means 5 in reciprocating movement so that the piston 6 performs pumping and creates a pulsating pressure of a fuel introduced through the line 7 and discharged through the line 8. Non-return valves 9 and 10 maintain the pumping function.

Furthermore the piston 11 is driven for reciprocating movement and sucks air through the line 12 via a non-return valve 13, and air at a suitable pressure is discharged through the line 14 via the non-return valve 15.

At the lower end of the body 1 an operating jet 16 is adapted. It comprises in known manner a valve body, which is yieldingly loaded against a valve seat in a direction contrary to the flow direction of the fuel so that the valve body performs vibrations towards and from the valve seat at the supply of the fuels with pulsating pressure from the channel 8 and between the valve body and the valve seat. Consequently the fuel will be fed from the jet finely distributed and with rapid pulsations. The electromagnetic means 5 operates at a certain frequency, let us say 50 periods per second, the pulsations of the fuel thus being created via the pump piston 6. The voltage supplied to the electromagnetic means 5 can be varied by means of a suitable control 17 and in this way the power of the electromagnetic means is varied and consequently the pulse pressure of the piston-cylinder-pump device 2, 6, thus making it possible to vary the pressure of the pulses which has the effect that the valve body of the jet 16 known per se opens more or less from the valve seat so that fuel is sprayed out of the jet to a smaller or larger degree. The frequency of the pulses are thus the same the whole time, but the device allows variation of sprayed amount through the jet 16 through the variation of supplied to the electromagnetic means 5.

The housing 1 can be directly adapted in a furnace so that the operating jet gets a suitable position for supply of fuel to the furnace, it being possible to add the secondary air in conventional manner. The electromagnetic means 5 can consist of an electromagnet with a reciprocating core.

In a further development of the device a sleeve 18 is adapted against the housing 1. The sleeve 18 is inserted in the wall 19 of the furnace and a lower portion of the sleeve is placed inside the furnace. At the interior portion of the sleeve inside the furnace a starting nozzle 20 is arranged. The starting nozzle receives fuel via the line 21 and a magnet valve 22 from the piston-cylinder-pump device 2. Combustion air is received via the line 23 from the compressor device 3. The starting nozzle 20 is a conventional spraying nozzle, where air and fuel are mixed and sprayed through apertures in the starting nozzle 20. Ignition electrodes 24 with an ignition transformer 25 are adapted in conventional manner.

The further development of the device is especially suitable for pulsating combustion and the sleeve 18 is provided with apertures 26 within the furnace, the opening area of the apertures being adjusted by means of flaps 27. The flaps 27 open when a negative pressure is intermittently created by the pulsating combustion, a mixture of fuel and air in the sleeve 18 thus being sucked into the combustion chamber of the furnace. Air is supplied to the interior of the sleeve 18 through apertures 28 and the flow area of the apertures 28 is adjusted by means of a damper 29, the control of which is adjusted by means of an electrical means 30 sensitive to voltage. A certain voltage applied to the means 30 will thus provide a certain setting of the damper 29.

The supply voltage of the magnet valve 22 and the ignition voltage of the ignition transformer 25 are supplied via a contactor 31, which is operated by means of bellows not shown, which senses negative pressure within the sleeve 18 or within the combustion chamber of the furnace by means of a line 32. When a negative pressure arises, this is sensed by the bellows not shown, and the contactor 31 breaks the circuit so that the electromagnet 22 and the ignition transformer 25 will be dead.

The function of the device is as follows. Starting air is supplied from the compressor piston 11 via the lines 14 and 23 to the starting nozzle 20. Oil is supplied to the starting nozzle 20 from the piston-cylinder-pump device 2 via the magnet valve 22, which is under voltage at start. The mixture of fuel and air sprayed out of the jet 20 is ignited by means of the electrodes 24 and the pulsating combustion is ignited. At the pulsating combustion an intermittent negative pressure is created in the combustion chamber and the negative pressure is immediately sensed by the line 32 and the bellows not shown, so that the contactor 31 breaks the supply of voltage to the magnet valve 22 and the ignition transformer 25. In this way the supply of fuel to the starting jet is interrupted. The operating jet 16 has a greater restriction resistance than the starting nozzle 20, and when the magnet valve 22 is open the fuel from the piston-cylinder-pump device 2 will flow to the starting nozzle. However, as the magnet valve has now closed off the supply of fuel to the starting nozzle the fuel will be supplied to the jet 16 and fuel will be sprayed finely distributed and pulsating inside the sleeve 18 and be mixed with the air supplied through the apertures 28.

The negative pressure produced at the pulsating combustion opens the flaps 27 and sucks the mixture of fuel and air from the sleeve 18, and the pulsating combustion can go on in the usual, known way. If for some reason or other the pulsating combustion ceases, the contactor 31 will close the circuit so that voltage is supplied to the magnet valve 22 and the ignition transformer 25, the starting nozzle starting operation again.

A transfer pipe 33 is connected between the magnet valve 22 and the inlet line 7, and thus a constriction 34 decides the pressure of the fuel fed through the line 21 to the starting nozzle 20.

A means 35 is inserted in the furnace and this means, e.g. a thermoelement, varies a supply voltage as a function of the temperature sensed by the means. A voltage dependent on the temperature can be taken from the contact points 36, and this voltage can preferably be used as a supply voltage for the means 30 adjusting the air damper 29 and for the electromagnetic means 5 for variation of the supplied amount of fuel. In this way the yielded effect of the jet 16 can be steplessly varied within wide limits, i.e. from practically nil to full effect. The control of the fuel and supplied combustion air will be so good by means of the device that at all settings a very good mixture of fuel and air is obtained, which will provide a satisfactory combustion.

The device shown in the drawing relates merely to a possible embodiment of the invention and the illustration is also schematic. There are variation possibilities for most of the details shown and especially the piston-cylinder-pump device, the compressor, the electromagnetic means, the damper 29 with control means 30 and the starting nozzle 20 itself.

What is claimed is:

1. In a compressed oil burner, having an operating nozzle comprising a valve body, which is yieldingly loaded against a valve seat in a direction contrary to the flow direction of the fuel, said fuel being supplied at a pulsating pressure, the improvement comprising a separate starting nozzle means arranged in front of said operating nozzle, said starting nozzle means being comprised of an air-fuel mixing chamber with outflow apertures and fuel and combustion air introduction means so that fuel and combustion air are supplied to said chamber while the fuel supply to said operating nozzle is closed.

2. The device according to claim 1, including a big restriction resistance for said operating nozzle and a control valve for fuel supply to said starting nozzle as compared with the starting nozzle and wherein said operating nozzle and said starting nozzle are connected in parallel for the fuel supply.

3. The device according to claim 1, including a cylinder-piston compressor to supply combustion air for said starting nozzle and a cylinder-piston pump to supply fuel under pulsating pressure to the operating nozzle, said cylinder-piston pump being operated by electromagnet means which output is controlled by voltage.

4. The device according to claim 2, including an electromagnet for operating said control valve for the fuel supply to the starting nozzle and a conductor in the electrical circuit of said electromagnet to open said circuit and which is controlled by the pressure changes in the combustion chamber.

5. A device including an oil burner adapted for operation of pulsating combustion and including a fuel injecting nozzle, means for supplying air to said fuel injection nozzle, a tube, a starting nozzle arranged on said tube, which encloses and extends from said injecting nozzle and in the axial direction of said nozzle, said tube to extend at least with its outer end into a combustion chamber and supporting said starting nozzle within said combustion chamber, the portion of said tube in the combustion chamber defining apertures with check valves, which open into the combustion chamber under negative pressure and said tube defining air supply apertures for said portion outside the combustion chamber.

6. The device according to claim 5, including adjustable dampers for the apertures on the tube for the air supply, electrical means to operate said dampers whose setting is controlled by the voltage supplied, and temperature sensing means in a furnace operated by the oil burner which sets said voltage.

* * * * *